US009067103B2

(12) United States Patent
Fabbri et al.

(10) Patent No.: US 9,067,103 B2
(45) Date of Patent: Jun. 30, 2015

(54) GYMNASTIC MACHINE

(75) Inventors: Gianmatteo Fabbri, Santarcangelo di Romagna (IT); Carlo Moroni, Rimini (IT)

(73) Assignee: TECHNOGYM S.P.A., Gambettola (FC) (IT)

( * ) Notice: Subject to any disclaimer, the term of this patent is extended or adjusted under 35 U.S.C. 154(b) by 503 days.

(21) Appl. No.: 13/365,435

(22) Filed: Feb. 3, 2012

(65) Prior Publication Data

US 2012/0202651 A1 Aug. 9, 2012

(30) Foreign Application Priority Data

Feb. 4, 2011 (IT) ..... RA2011A0004

(51) Int. Cl.

| | |
|---|---|
| ***A63B 21/00*** | (2006.01) |
| ***A63B 22/00*** | (2006.01) |
| ***A63B 22/06*** | (2006.01) |
| *A63B 21/005* | (2006.01) |
| *A63B 21/22* | (2006.01) |
| *A63B 22/20* | (2006.01) |

(52) U.S. Cl.

CPC ..... *A63B 21/155* (2013.01); *A63B 22/001* (2013.01); *A63B 22/0664* (2013.01); *A63B 2022/0676* (2013.01); *A63B 21/0052* (2013.01); *A63B 21/15* (2013.01); *A63B 21/225* (2013.01); *A63B 22/20* (2013.01)

(58) Field of Classification Search

USPC ..... 482/72, 52, 70, 51

See application file for complete search history.

(56) References Cited

U.S. PATENT DOCUMENTS

| | | | | |
|---|---|---|---|---|
| 5,876,308 | A | 3/1999 | Jarvie | |
| 2003/0022763 | A1 | 1/2003 | Ryan | |
| 2006/0058159 | A1 | 3/2006 | Eschenbach | |
| 2008/0032867 | A1 * | 2/2008 | Liao et al. | 482/52 |

FOREIGN PATENT DOCUMENTS

DE 34 29 185 A1 2/1986

OTHER PUBLICATIONS

European Search Report dated Sep. 22, 2011.

* cited by examiner

*Primary Examiner* — Jerome W Donnelly

(74) *Attorney, Agent, or Firm* — Abelman, Frayne & Schwab

(57) ABSTRACT

A gymnastic machine (1) comprising a frame (10) supporting a load group (20) that can be actuated cyclically for power exchange with a user during training; a pair of first levers (24), substantially identical to each other, each of which being carried by the frame (10) in a rotatable manner around a first pivot axis (A1) and being provided with a respective interface (243), so that the interface (243) can move cyclically along a given trajectory (T); a transmission group (30) being provided mechanically to connect the first levers (24) with the load group (20); the transmission group (30)(30') comprising a modulating device (300')(300) designed to limit a speed change of each user interface (243) along the annular trajectory (T) and to avoid, in use, a sudden movement of the interface (243) transversally to the trajectory (T) as the motion is inverted.

21 Claims, 2 Drawing Sheets

GYMNASTIC MACHINE

FIELD OF THE INVENTION

The present invention relates to a gymnastic machine. In particular, the present invention relates to a gymnastic machine designed for cyclical leg training. In more detail, the present invention relates to a gymnastic machined designed for cyclical leg training using footrests that can move along a substantially elliptical trajectory.

BACKGROUND OF THE INVENTION

In the field of gymnastic machines the production of cardiovascular training equipment is well known, that allows simulating the execution of a physical activity, such as running or walking, by means of a cyclical load group, as well as of equipment designed to exchange power with the user through footrests forced to move along a given trajectory. Without limiting the general scope of the present invention, some gymnastic machines are well known, wherein the load group can be actuated through footrests, which can move along substantially elliptical trajectories and on which the user's feet constantly rest, allowing running or walking simulation avoiding injuries to the lower limb articulations. In view of what described above, these machines are usually called of the "elliptical type" or simply "elliptical"; they are provided with a load group usually comprising a wheel, to which two arms are connected through respective end portions in diametrically opposite position. Usually, a flywheel is mechanically coupled to this wheel for energy store to increase the footrest motion fluency. Each arm is furthermore connected, through a respective free end, to a longitudinal track, arranged laterally and parallel to the flywheel.

In view of the above description it is clearly apparent that each flywheel-arm pair is similar in structure to that described above, so as to operate according to the scheme of the rod-crank mechanism, also known as "crank and slider mechanism", wherein the flywheel functions as a crank and each arm functions as a connecting rod and wherein the substantially horizontal track functions as the cylinder/tube of the mechanism. Each arm carries the corresponding footrest in intermediate position; a power dissipator is associated with the flywheel allowing to adjust the effort the user must exert on the pedals to perform the training exercise. It is therefore useful to specify that the object of the flywheel is to regulate the machine operation, making it fluent. In view of the above description, hereinafter reference will be usefully made to the terminology known to those skilled in the field of the crank and slider mechanisms, and therefore to the terms "top dead centre" and "bottom dead centre", or, better, to their convenient forms "front dead centre" and "rear dead centre", as in this case the axis of movement of the rod/arm ends is substantially horizontally arranged. The broad use of these terms will allow to talk about front dead centre and rear dead centre of arms/rods in, and of, the footrests based upon the context, even if only one of the speed components of these footrests will be null as the motion will be inverted.

In elliptical machines the track inclination can be fixed or variable, as it is well known from numerous examples of machines produced by the US firm Precor and from numerous US patents invented by Larry Miller, starting from the first U.S. Pat. No. 5,755,642 disclosing the operating principle of the elliptical machines, and the teachings of Robert E. Rodgers. In some versions of these machines, the load group comprises a flywheel arranged at the front, to facilitate the access to the machine; in other cases, and usually in the machines produced by Precor and embodying the patent US '642 and the following patents, the load group is arranged at the back. This complicates the access to the machine, that must necessarily occur from the side, as well as the descent from the footrests once the exercise has ended; in fact, the user must go down in the same way he/she has gone up, i.e. from the side and not backwards, as it would be spontaneous, to avoid tripping over the cover of the load group or the joint between the levers and the flywheel.

To overcome the prior art patents and the drawbacks illustrated above, many gymnastic machines for elliptical training are based upon mechanisms arranged at the front. On the other hand, drawbacks are associated with the front arrangement of the mechanism regulating the machine operation and the footrest movement along elliptical trajectories. It is useful to highlight one of these drawbacks, which can make the use of the machine particularly unpleasant. With reference again to the above illustrated analogy with the crank and slider mechanism, it should be noted that the front arrangement of the cranks/flywheel gives each footrest an acceleration peak when the corresponding connecting rod is at the rear dead centre. The greater the power exchanged by the user with the machine the more unpleasant is the perception of this acceleration peak; and the faster is the footrest actuation speed the more sharp is this perception, so that the effect is jargonally called "foot kick". In view of the above description the elliptical gymnastic machines are poorly indicated for training sessions wherein high forces must be exchanged through the footrests, and they are therefore usually reserved for poorly conditioned users interested in performing low impact training.

In view of the above description, the problem of producing elliptical machines for practical and pleasant use as regards going up and down the footrests is currently unsolved, and represents an interesting challenge for the Applicant.

In view of the situation described above, as well as of a market growth of the cyclical machines that allow to perform cardio-vascular training by preventing articulation injuries, it would be desirable to have available a gymnastic machine provided with a device that, in addition to limit and possibly to overcome the typical drawbacks of the prior art illustrated above, defines a new standard of this type of equipment.

SUMMARY OF THE PRESENT INVENTION

The present invention relates to a gymnastic machine. In particular, the present invention relates to a gymnastic machine designed for cyclical leg training. In more detail, the present invention relates to a gymnastic machined designed for cyclical leg training using footrests that can move along a substantially elliptical trajectory.

The object of the present invention is to provide a modulating device for a gymnastic machine which allows the disadvantages described above to be solved, and which is suitable to satisfy a plurality of requirements that to date have still not been addressed, and therefore suitable to represent a new and original source of economic interest, capable of modifying the current market of the gymnastic equipment.

According to the present invention, a modulating device for a gymnastic machine is provided, whose main characteristics will be described in at least one of the appended claims.

A further object of the present invention is to provide a gymnastic machine which allows the disadvantages described above to be solved, and which is suitable to satisfy a plurality of requirements that to date have still not been addressed, and therefore suitable to represent a new and original source of economic interest, capable of modifying the current market of the gymnastic equipment.

According to the present invention, a gymnastic machine is provided, whose main characteristics will be described in at least one of the appended claims.

BRIEF DESCRIPTION OF DRAWINGS

Further characteristics and advantages of the gymnastic machine according to the present invention will be more apparent from the description below, set forth with reference to the accompanying drawings, which illustrate some non-limiting examples of embodiment, in which identical or corresponding parts of the device are identified by the same reference numbers. In particular.

DETAILED DESCRIPTION OF THE PRESENT INVENTION

Figure 1:
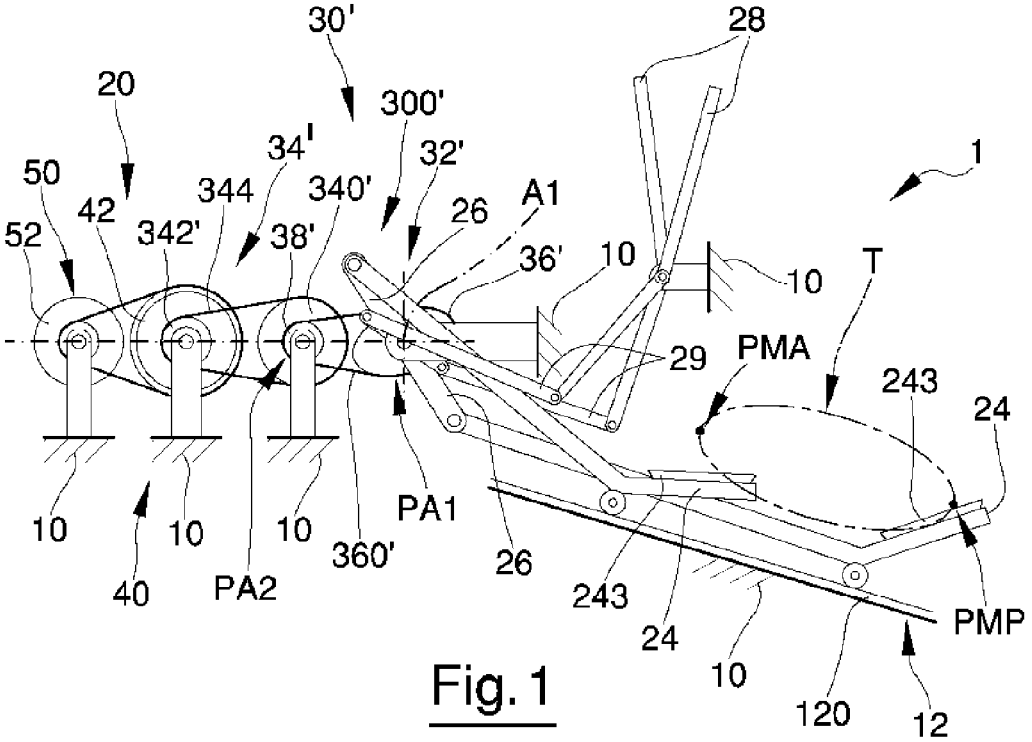
FIG. 1 shows a side elevation schematic view of a machine according to the present invention.

In FIG. 1, number 1 indicates in its entirety a gymnastic machine comprising a frame 10 supporting a load group 20 that can be actuated cyclically for power exchange with a user during training. It should be noted that in the attached drawings the frame 10 is illustrated through a group of lines inclined by 45° relative to a horizontal or vertical direction, with the only purpose of simplifying the drawing and the understanding of the present invention. The load group comprises a pair of substantially identical first levers 24; both these first levers 24 being coupled to the frame 10 in a given way to be operable in opposition of phase as will be better explained in the followings. Each first lever 24 presents a first end portion 240 connected to the frame 10 by means of a crank 26 or other functionally equivalent member that forces this first end 240 to rotate around a first pivot axis A1; each first lever 24 furthermore comprises a second portion 242 coupled to the frame 10 in a freely slidable manner through a track 12 arranged transversally to the first pivot axis A1. Each first lever 24 presents a respective interface 243, and is carried from the frame 10 in order to let said interface 243 be movable cyclically along a substantially elliptical given trajectory T. This trajectory T extends substantially annular between a first position of front dead centre PMA and a second position of rear dead centre PMP. The first position PMA is in particular placed at an end point of the trajectory of the interface 243, at the side of the first pivot axis A1. Therefore, this first position PMA is substantially positioned at the front relative to the machine 1. The rear dead centre second position PMP is substantially positioned at a posterior end point of the trajectory of the interface 243, at opposite side from the first pivot axis A1. For the sake of practicality, hereinafter the front and rear dead centres PMA and PMP will be also indicated with the term "points of motion inversion", as they are arranged on the trajectory T at end points of the respective longitudinal position and near these points the movement towards the footrest rear portion is inverted and becomes motion towards the front part of the machine 1 and vice versa.

It is easily understood that in this description explicit reference is made to an elliptical machine, better described below, without however limiting the general scope of the present invention, which can be easily applied to cyclical machines provided with levers that can be actuated cyclically. For the sake of practicality it should be therefore specified that, with reference to FIG. 1 again, each interface 243 comprises a footrest 243 and that each track 12 can present adjustable inclination relative to the frame 10 through the use of a known and therefore not illustrated adjusting unit.

Figure 2:
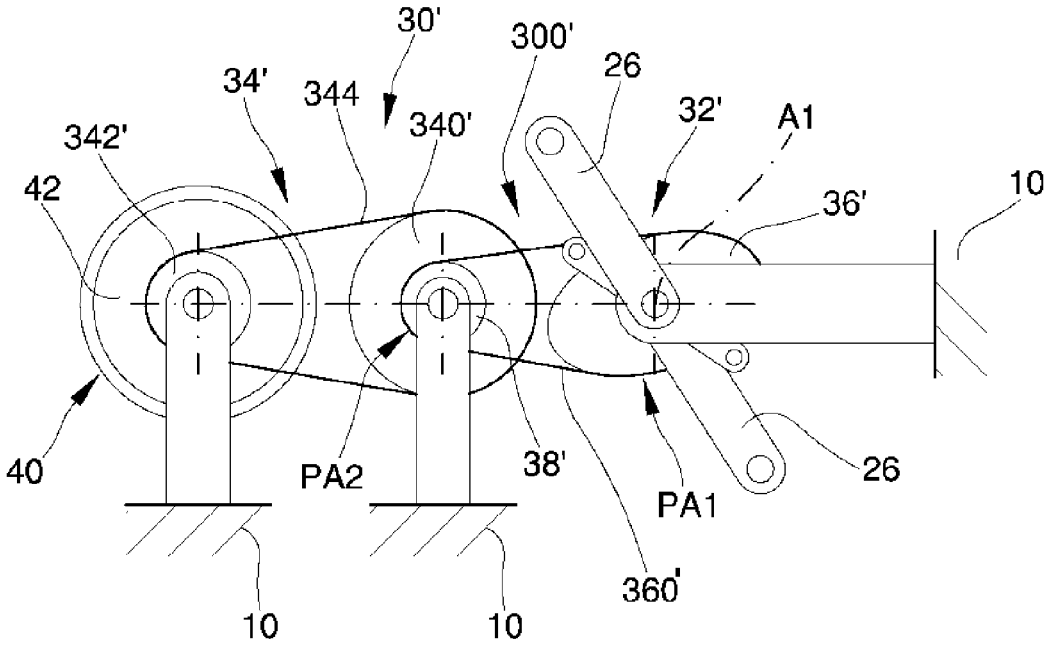
FIG. 2 is an enlarged view of FIG. 1 with some parts removed for the sake of clarity.

The machine 1 furthermore comprises a transmission group 30' mechanically connecting the first levers 24 with the load group 20 and in particular with a respective energy accumulating member 40 that is carried pivotable by the frame 10 around an axis parallel to the first pivot axis A1 and that, in use, has the function of increasing the motion fluency of the interfaces 243. With particular reference to FIGS. 1 and 2, the transmission group 30' comprises a transmission first stage 32' and a transmission second stage 34' with parallel axes that are mechanically coupled to each other through a modulating device 300'. This modulating device 300', which will be better described below, is designed to vary the acceleration of each footrest 243 along the annular trajectory T so that, in use, the trend of this parameter changes continuously and gradually as spontaneously occurs during walking and running. The acceleration change of each footrest will be therefore conform to the biomechanics of the articulation natural movement, and it will be therefore perceived as "physiologically acceptable" by all users, independently of their athletic preparation.

With reference to FIG. 2, the first stage 32' comprises, in particular, a rotating first and a rotating second members 36' and 38', carried by the frame 10 in a freely rotatable manner around respective axes parallel to the first pivot axis A1. The rotating first member 36' is delimited by an annular first profile PA1 of the type convex in all points and could present polar symmetry, if deemed necessary. The rotating second member 38' is delimited by an annular second profile PA2, which can take round or not-round shape according to the specific needs. Moreover, the rotating first and second members 36' and 38' are coupled to each other by means of a flexible member 360', which can indifferently comprise a belt or a chain according to the project requirements. For the sake of simplicity, in FIGS. 1 and 2 the annular first profile PA1 has been represented by means of a substantially oval or elliptical closed curve. The cranks 26 are rigidly coupled to the rotating first member 36' at diametrically opposite sectors, known and therefore not shown.

The accumulating member 40 comprises a flywheel 42 designed to make regular the angular speed of the rotating first member 36'. The machine 1 furthermore comprises a known dissipating member 50, which can be actuated by means of an electromagnetic brake 52, which is mechanically connected to the flywheel 42, for instance, although without limitation, through a known belt, that should be a toothed belt if necessary due to the specific torques involved.

With particular reference to FIGS. 1 and 2, the modulating device 300' comprises the first stage 32', so that the motion produced by the user by actuating the footrests 243 is immediately modulated as regards speed and acceleration through the accumulating member 40. In view of the above description, the modulating device 300' decreases the absolute value of speed and acceleration peaks or steps of the footrests 243, making the movement imposed to the articulation pleasant and acceptable both at physical and mental level when the motion is inverted, i.e. when in use the footrests 243 cross the second position of rear dead centre PMP. It should be specified that in this position the footrests 243 are subjected to the maximum value of the thrust exerted by the user and they exchange therefore more power with the load group 20. The modulating device 300' is therefore designed to introduce a change in the instant value of the transmission ratio between the rotating first and second members 36' and 38' to limit the amplitude of the acceleration change of the footrests 243. It should be noted that choosing a non-circular rotating second member 38' can be particularly useful when you want to use the machine 1 by actuating the cranks 26, and therefore the flywheel 42, in clockwise and anticlockwise direction, which requires a belt with substantially constant extension, without using tensioning devices which operate adequately only for a given direction of rotation.

In view of the above description, and with particular reference to the instant variability of the value of the transmission ratio depending upon the conformation of the first stage 32' and, in particular, of the rotating first and second members 36' and 38', it is necessary that these latter are coupled to each other in a synchronous manner. It is easily understood that in case the flexible member 360' coupling them must should be devoid of relative slip with respect to the coupled members, and it must therefore comprise a toothed belt or be substituted by any other member/device mechanically equivalent. The second stage 34' comprises a first wheel 340' and a second wheel 342', both carried by the frame 10 in a rotatable manner parallel to the first pivot axis A1. The first wheel 340' and the second wheel 342' are mechanically coupled to each other through a belt 344' or any other flexible member with analogous function. The first wheel 340' is coaxial with the rotating second member 38'.

According to the requirements of the user, who could be also interested in training the body upper part, the machine 1 can selectively comprise a pair of second levers 28, each of which is carried in a rotatable manner by said frame 10 around an axis parallel to or inclined relative to the first pivot axis A1 according to specific needs. Each second lever 28 is coupled to the rotating first member 36' through the interposition of a respective connecting rod 29 to be movable in phase with the respective first lever 24. The connecting rods 29 are coupled to the rotating first member 36' at diametrically opposite points relative to the connection points of the cranks 26. It should be noted that the phase value between the connection points of the cranks 26 and of the connecting rods 29 must be defined at the design stage according to specific needs linked with the methods of use desired for the machine 1.

The operation of the machine 1 and of the respective modulating device 300' is easily understood from the description above and does not require further explanations.

In view of the above description, the set of the rotating first and second members 36' and 38', together with the flexible member 360' that is designed to synchronise the rotary motion, defines the first stage 32' and constitutes the functional group upon which the acceleration modulation of the interfaces/footrests 243 depends. It should be furthermore specified that the particular arrangement of the components, concentrated at the side of the load group 20, gives the machine 1 a particular easiness of use which allows the user to access the footrests 243 easily, without obstacles, and therefore also to go down from the footrests once the training has been completed proceeding backwards for the same reason. On the other hand, this configuration of the machine 1 allows to limit the longitudinal dimension.

It should be noted that, if you desire to limit the bulk of the transmission group 30', it would be possible coaxially to couple rigidly the flywheel 42 and the first wheel 340' or, alternatively, replace the first wheel 340' with another wheel of sufficient mass to act as a kinetic energy accumulator. It is clearly apparent that, in this case, it would be possible to eliminate the second stage 34' and that the position occupied in FIG. 2 by the flywheel 42 would be occupied by the electromagnetic brake 52.

Lastly, it is clearly apparent that modifications and variants can be made to the gymnastic machine 1 and to the respective modulating device 300' described and illustrated herein, without however departing from the protective scope of the present invention.

In particular, the transmission group 300' can be modified, however maintaining the requirement of the variable transmission ratio, so as to reduce its production cost, which is particularly high due to the construction features of the rotating first member 36' and of the rotating second member 38', to which the annular non-circular profiles PA1 and PA2 are respectively associated.

Figure 3:
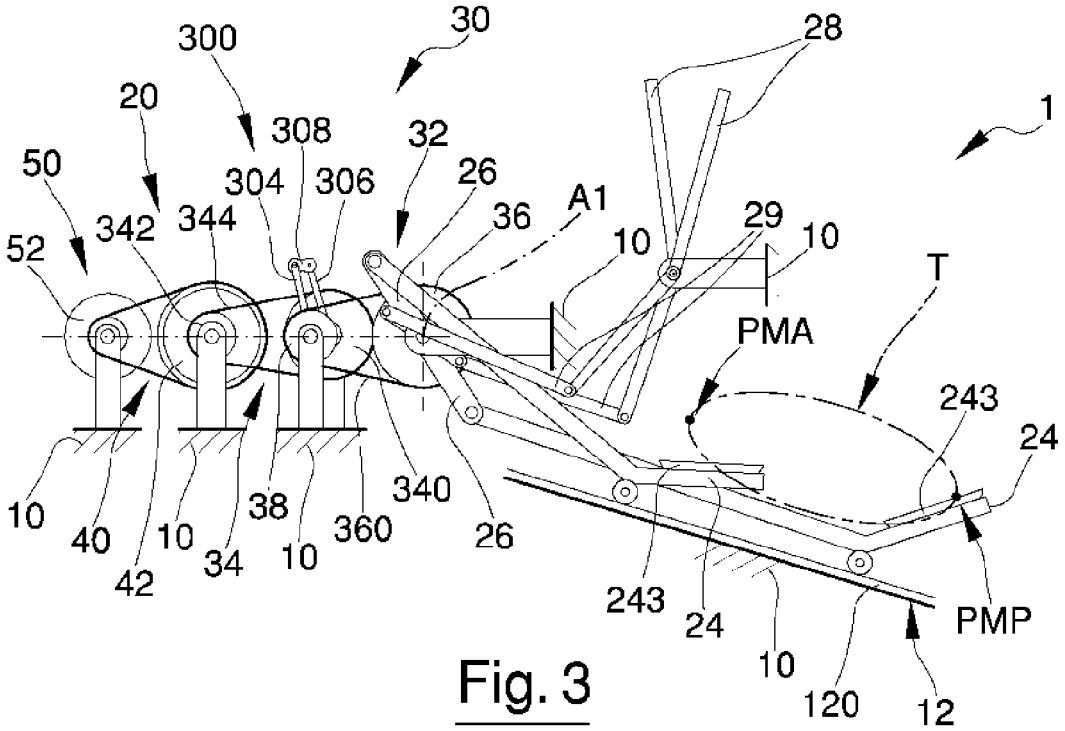
FIG. 3 shows a variant of FIG. 1.
Figure 4:
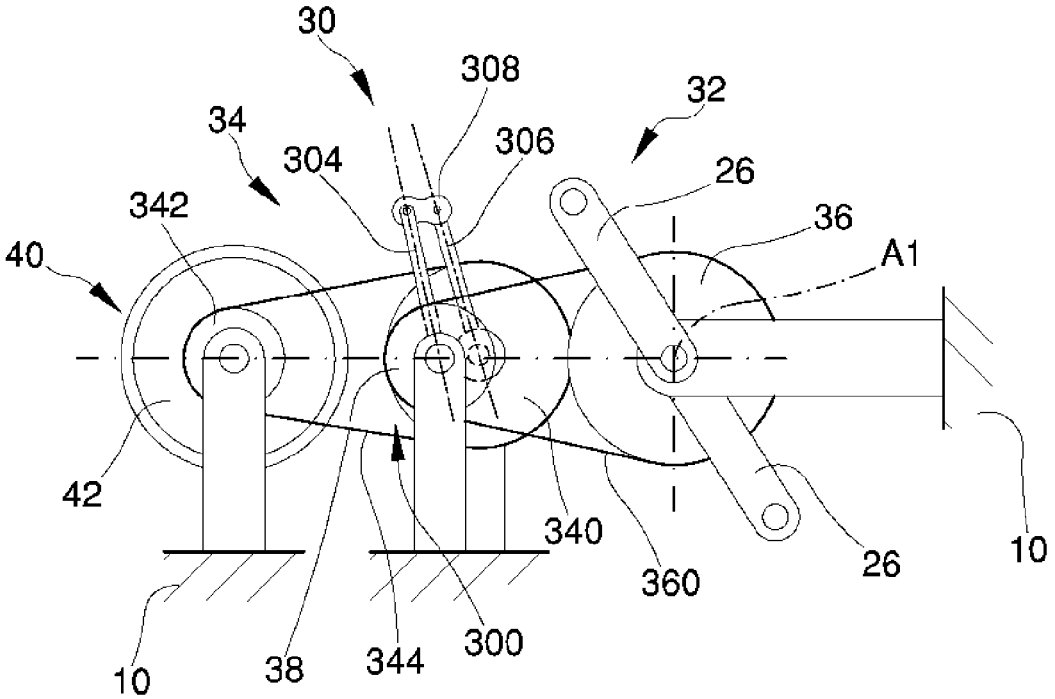
FIG. 4 is an enlarged view of a device extracted from FIG. 2 with some parts removed for the sake of clarity.

In this regard, the machine 1 can comprise a modulating device 300 comprising an articulated device 302 arranged between the first stage 32 and the second stage 34 mechanically to couple them to each other. In this case, the first stage 32 presents the respective rotating first member 36 and the respective rotating second member 38 provided with a third wheel 36 and a fourth wheel 38 carried by the frame 10 in a rotatable manner around parallel pivot axes. With reference to FIGS. 3 and 4 again, the articulated device 302 comprises a first crank 304 rigidly connected to the fourth wheel 38, and a second crank 306 rigidly connected to the first wheel 340; the first crank 304 and the second crank 306 are connected to each other through a connecting rod 308. For all the above, the articulated device 302 comprises a four bar linkage.

With reference to FIGS. 3 and 4 again, it should be noted that the fourth wheel 38 of the first stage 32 and the first wheel 340 of the second stage 34 are mutually rotatable relative to parallel and distinct pivot axes and are coupled mechanically by means of the four bar linkage 302, which is designed to vary the transmission ratio between the first stage 32 and the second stage 34 accordingly. The second stage 34 furthermore comprises a flexible second member 344 wound in a loop around the first wheel 340 and around the second wheel 342, to couple them mechanically into rotation.

In this case again, if you desire to limit the bulk of the transmission group 30, it would be possible coaxially to couple rigidly the flywheel 42 and the first wheel 340' or, alternatively, replace the first wheel 340' with another wheel of sufficient mass to act as a kinetic energy accumulator. In this case again, it would be possible to eliminate the second stage 34 and to position the electromagnetic brake 52 in the place occupied by the flywheel 42 in FIG. 2.

In view of the above description, the gymnastic machines 1 provided with the two versions of the modulating device, respectively indicated with the reference numbers 300' and 300, allows to solve the problem of making regular the acceleration of the user interfaces/footrests 243 of elliptical machines with facilitated access, i.e. elliptical machines wherein the load group 20 is arranged at the front, through the variation of the transmission ratio between the two stages 32 and 34 mechanically coupled together in synchronous manner. In particular, the construction features of the modulating devices 300' and 300 described above allow the Applicant to widen the market of these cyclical machines eliminating the effect defined above "foot kick", by eliminating the acceleration peaks when the footrests 243 cross the respective rear dead centres of the respective trajectories.

What is claimed is:

1. A modulating device (300')(300) for a gymnastic machine (1) comprising a frame (10) supporting a load group (20) that can be actuated cyclically for power exchange with a user during training; at least one first lever (24) carried by said frame (10) in a rotatable manner around a first pivot axis (A1) and provided with a respective user interface (243) cyclically movable along a closed trajectory (T) longitudinally delimited by a first position (PMA) and by a second position (PMP) of inverting the motion of said interface (243); a transmission group (30')(30) being provided to connect mechanically each said first lever (24) to said load group (20); characterised by comprising operating means (32')(302) designed to modulate an acceleration of each said user interface (243) along said trajectory (T) to maintain said acceleration, in use, near to physiological values;

wherein said operating means (32') comprises a first rotating member (36')(36) and a second rotating member (38')(38) carried by said frame (10) in a freely rotatable manner around axes parallel to one another and to said first pivot axis (A1), mechanically coupled to one another synchronously and respectively delimited by profiles (PA1)(PA2) of given shape;

wherein said first rotating member (36') and said second rotating member (38') are delimited by convex profiles (PA1)(PA2) in each point and are mechanically coupled to each other by means of a flexible member (360') in a substantially synchronised manner devoid of relative slip with respect to the coupled members; and wherein said first rotating member (36') is delimited by an annular profile (PA1) of substantially oval or elliptical shape.

2. A device according to claim 1, wherein said machine (1) presents two said first levers (24) coupled to said frame (10) in order to be activated in phase opposition; each said first lever (24) being provided of a said user interface (243) acting as a footrest to give said trajectory (T) a substantially elliptical shape; said operating means (32')(302) being designed to maintain said acceleration of said user interface within physiological values in at least one of said first position (PMA) and second position (PMP) of said trajectory (T).

3. A device according to claim 1, wherein said transmission group (30')(30) comprises a first stage (32') and a second stage (34') with parallel axes, mechanically coupled to each other through said operating means (32'); said first stage (32') comprising said operating means (32').

4. A device according to claim 2, wherein said operating means (302) comprises an articulated mechanism (302).

5. A device according to claim 4, wherein said articulated mechanism (302) comprises a four bar linkage (302).

6. A device according to claim 5, wherein said transmission group (30) comprises a first stage (32) and a second stage (34) with parallel axes, mechanically coupled to each other through said four bar linkage (302); said first stage (32) comprising said first and second rotating members (36)(38).

7. A device according to claim 6, wherein said four bar linkage (302) comprises a pair of first cranks (304, 306).

8. A gymnastic machine (1) comprising a frame (10) supporting a load group (20) that can be actuated cyclically for power exchange with a user during training; at least one first lever (24) carried by said frame (10) in a rotatable manner around a first pivot axis (A1) and provided with a respective interface (243) cyclically movable along a closed trajectory (T) longitudinally delimited by a first position (PMA) and by a second position (PMP) of inverting the motion of said interface (243); a transmission group (30) being provided to connect mechanically said first levers (24) with said load group (20); characterised in that said transmission group (30)(30') comprises a modulating device (300')(300) designed to modulate an acceleration of each said interface (243) along said trajectory (T) to maintain said acceleration, in use, near to physiological values;

wherein said modulating device (300')(300) comprises a first rotating member (36')(36) and a second rotating member (38')(38) with parallel axes and parallel to said first pivot axis (A1), respectively delimited by profiles (PA1)(PA2) of given shape in order to allow instantaneous variation of the transmission ratio and mechanically coupled to each other synchronously;

wherein said profiles (PA1)(PA2) of given shape are convex in each point and said first rotating member (36') and said second rotating member (38') are mechanically coupled to each other by means of a flexible member (360') devoid of relative slip with respect to the coupled members; and wherein said first rotating member (36') is delimited by an annular profile (PA1) of substantially oval or elliptical shape.

9. A machine according to claim 8, wherein it comprises two said first levers (24) coupled to said frame (10) in order to be activated in phase opposition; each said first lever (24) being provided of a said user interface (243) acting as a footrest to give said trajectory (T) a substantially elliptical shape; said modulating device (300')(300) being designed to maintain said acceleration of said interface (243) near to physiological values in at least one of said first position (PMA) and second position (PMP) of said trajectory (T).

10. A machine according to claim 8, wherein said transmission group (30') comprises a first stage (32') and a second stage (34') with parallel axes mechanically coupled to each other through said modulating device (300'); said first stage (32') comprising said modulating device (300').

11. A machine according to claim 10, wherein said second stage (34') comprises a third wheel (340') and a fourth wheel (342') carried by said frame (10) in a rotatable manner parallel to said first pivot axis (A1); said third wheel (340') and fourth wheel (342') being coupled to each other mechanically.

12. A machine according to claim 11, wherein said third wheel (340') is coaxial to said second rotating member (38').

13. A machine according to claim 12, wherein said load group (20) is provided with an energy storing member (40) carried rotatable by said frame (10) suitable to adjust an angular speed of said first rotating member (36'); each said interface (243) comprising a footrest (243) carried by the respective said first lever (24) between a respective first portion (240), connected with said fame (10) in a freely rotatable manner through a second crank (26), and a respective second portion (242), coupled with said frame (10) in a freely slidable manner through a respective track (12) arranged transversally to the first pivot axis (A1), so that said footrest (243) is movable with substantially alternating motion along said trajectory (T) and that this latter presents a substantially annular shape, each said second crank (26) being rigidly coupled to said first rotating member (36') so as to be rotatable relative to said frame (10) parallel to said first pivot axis (A1); said second cranks (26) being coupled to said first rotating member (36') at diametrically opposite points relative to said first pivot axis (A1).

14. A machine according to claim 8, wherein said modulating device (300') comprises a four bar linkage (302) provided of a third and a fourth cranks (304)(306).

15. A machine according to claim 14, wherein said transmission group (30) comprises a first stage (32) and a second stage (34) with parallel axes mechanically coupled to each other through said four bar linkage (302); said second stage (34) comprising a third wheel (340) and a fourth wheel (342) carried by said frame (10) in a rotatable manner parallel to said first pivot axis (A1); said third wheel (340) and fourth wheel (342) being coupled to each other mechanically; said first stage (32) comprising said first and second rotating members (36)(38).

16. A machine according to claim 15, wherein said third crank (304) is connected rigidly with said second rotating member (38) and said fourth crank (306) is connected rigidly with said third wheel (340); a first connecting rod (308) being arranged between said third and fourth cranks (304)(306) to connect them with each other mechanically.

17. A machine according to claim 16, wherein said second rotating member (38) and said third wheel (340) are mutually rotatable relative to pivot axes parallel and distinct from each other.

18. A machine according to claim 17, wherein said load group (20) is provided with an energy storing member (40) carried rotatable by said frame (10) suitable to adjust an angular speed of said first rotating member (36')(36); each said interface (243) comprising a footrest (243) carried by the respective said first lever (24) between a respective first portion (240), connected with said fame (10) in a freely rotatable manner through a second crank (26), and a respective second portion (242), coupled with said frame (10) in a freely slidable manner through a respective track (12) arranged transversally to the first pivot axis (A1), so that said footrest (243) is movable with substantially alternating motion along said trajectory (T) and that this latter presents a substantially annular shape, each said second crank (26) being rigidly coupled to said first rotating member (36) so as to be rotatable relative to said frame (10) parallel to said first pivot axis (A1); said second cranks (26) being coupled to said first rotating member (36) at diametrically opposite points relative to said first pivot axis (A1).

19. A modulating device (300')(300) for a gymnastic machine (1) comprising a frame (10) supporting a load group (20) that can be actuated cyclically for power exchange with a user during training; at least one first lever (24) carried by said frame (10) in a rotatable manner around a first pivot axis (A1) and provided with a respective user interface (243) cyclically movable along a closed trajectory (T) longitudinally delimited by a first position (PMA) and by a second position (PMP) of inverting the motion of said interface (243); a transmission group (30')(30) being provided to connect mechanically each said first lever (24) to said load group (20); characterised by comprising operating means (32')(302) designed to modulate an acceleration of each said user interface (243) along said trajectory (T) to maintain said acceleration, in use, near to physiological values;

wherein said operating means (32') comprises a first rotating member (36')(36) and a second rotating member (38')(38) carried by said frame (10) in a freely rotatable manner around axes parallel to one another and to said first pivot axis (A1), mechanically coupled to one another synchronously and respectively delimited by profiles (PA1)(PA2) of given shape;

wherein said first rotating member (36') and said second rotating member (38') are delimited by convex profiles (PA1)(PA2) in each point and are mechanically coupled to each other by means of a flexible member (360') in a substantially synchronised manner devoid of relative slip with respect to the coupled members; and wherein said second rotating member (38') is delimited by a profile (PA2) of non-circular shape.

20. A modulating device (300')(300) for a gymnastic machine (1) comprising a frame (10) supporting a load group (20) that can be actuated cyclically for power exchange with a user during training; at least one first lever (24) carried by said frame (10) in a rotatable manner around a first pivot axis (A1) and provided with a respective user interface (243) cyclically movable along a closed trajectory (T) longitudinally delimited by a first position (PMA) and by a second position (PMP) of inverting the motion of said interface (243); a transmission group (30')(30) being provided to connect mechanically each said first lever (24) to said load group (20); characterised by comprising operating means (32')(302) designed to modulate an acceleration of each said user interface (243) along said trajectory (T) to maintain said acceleration, in use, near to physiological values;

wherein said machine (1) presents two said first levers (24) coupled to said frame (10) in order to be activated in phase opposition; each said first lever (24) being provided of a said user interface (243) acting as a footrest to give said trajectory (T) a substantially elliptical shape; said operating means (32')(302) being designed to maintain said acceleration of said user interface within physiological values in at least one of said first position (PMA) and second position (PMP) of said trajectory (T);

wherein said operating means (302) comprises an articulated mechanism (302); and wherein said articulated mechanism (302) comprises a four bar linkage (302).

21. A gymnastic machine (1) comprising a frame (10) supporting a load group (20) that can be actuated cyclically for power exchange with a user during training; at least one first lever (24) carried by said frame (10) in a rotatable manner around a first pivot axis (A1) and provided with a respective interface (243) cyclically movable along a closed trajectory (T) longitudinally delimited by a first position (PMA) and by a second position (PMP) of inverting the motion of said interface (243); a transmission group (30) being provided to connect mechanically said first levers (24) with said load group (20); characterised in that said transmission group (30)(30') comprises a modulating device (300')(300) designed to modulate an acceleration of each said interface (243) along said trajectory (T) to maintain said acceleration, in use, near to physiological values;

wherein it comprises two said first levers (24) coupled to said frame (10) in order to be activated in phase opposition; each said first lever (24) being provided of a said user interface (243) acting as a footrest to give said trajectory (T) a substantially elliptical shape; said modulating device (300')(300) being designed to maintain said acceleration of said interface (243) near to physiological values in at least one of said first position (PMA) and second position (PMP) of said trajectory (T);

wherein said modulating device (300')(300) comprises a first rotating member (36')(36) and a second rotating member (38')(38) with parallel axes and parallel to said first pivot axis (A1), respectively delimited by profiles (PA1)(PA2) of given shape in order to allow instantaneous variation of the transmission ratio and mechanically coupled to each other synchronously; and wherein said modulating device (300') comprises a four bar linkage (302) provided of a third and a fourth cranks (304)(306).

* * * * *